US010322893B2

(12) United States Patent
Nakajima

(10) Patent No.: US 10,322,893 B2
(45) Date of Patent: Jun. 18, 2019

(54) IMAGE FORMING APPARATUS

(71) Applicant: CANON KABUSHIKI KAISHA, Tokyo (JP)

(72) Inventor: Takao Nakajima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/458,318

(22) Filed: Mar. 14, 2017

(65) Prior Publication Data

US 2017/0275111 A1 Sep. 28, 2017

(30) Foreign Application Priority Data

Mar. 25, 2016 (JP) ..... 2016-062831

(51) Int. Cl.
*B65H 5/02* (2006.01)
*G03G 15/00* (2006.01)
(Continued)

(52) U.S. Cl.
CPC ..... *B65H 5/021* (2013.01); *B65H 5/025* (2013.01); *G03G 15/1615* (2013.01);
(Continued)

(58) Field of Classification Search
CPC ..... B65H 5/02; B65H 5/021; B65H 5/025; B65H 2403/20; B65H 2403/25;
(Continued)

(56) References Cited

U.S. PATENT DOCUMENTS 5,659,851 A * 8/1997 Moe ..... B65G 39/16 226/15
8,689,967 B2 * 4/2014 Kitamura ..... B65H 5/021 198/806

(Continued)

FOREIGN PATENT DOCUMENTS

JP 2001-192107 A 7/2001
JP 2002-333779 A 11/2002

(Continued)

OTHER PUBLICATIONS

European Search Report dated Jul. 7, 2017, in related European Patent Application No. 17159995.4.
European Search Report issued in corresponding EP Application 17 159 995.4-1022 dated Feb. 7, 2018.

*Primary Examiner* — Prasad V Gokhale
(74) *Attorney, Agent, or Firm* — Venable LLP

(57) ABSTRACT

An image forming apparatus includes an image forming portion, an endless belt and a plurality of stretching rollers. The stretching rollers includes a tiltable steering roller, a sliding member, a first stretching roller having a smallest diameter, and a second stretching roller having a largest diameter of the diameters. With respect to rotational axis directions of the stretching rollers, lengths of contact portions of the stretching rollers with the belt are shorter than a width of the belt, the length of the contact portion of the first stretching roller with the belt is a first length, the length of the contact portion of the second stretching roller with the belt is a second length shorter than the first length, and end positions of the contact portions of the first and second (Continued)

stretching rollers with respect to the rotational axis direction are different from each other.

9 Claims, 5 Drawing Sheets

(51) Int. Cl.
*G03G 15/16* (2006.01)
*G03G 15/08* (2006.01)

(52) U.S. Cl.
CPC ..... *G03G 15/6529* (2013.01); *B65H 2403/25* (2013.01); *B65H 2404/253* (2013.01); *B65H 2404/2511* (2013.01); *B65H 2801/06* (2013.01); *G03G 15/0879* (2013.01); *G03G 2215/00168* (2013.01); *G03G 2215/0132* (2013.01)

(58) Field of Classification Search
CPC ..... B65H 2404/2511; B65H 2404/253; B65G 41/001; B65G 41/008
USPC ..... 198/315
See application file for complete search history.

(56) References Cited

U.S. PATENT DOCUMENTS 9,114,643 B2 * 8/2015 Yasumoto ..... B41J 11/007
9,708,143 B2 * 7/2017 Hozumi ..... G03G 15/1615
2011/0274472 A1 * 11/2011 Inaba ..... G03G 15/1615 399/302
2011/0318048 A1 * 12/2011 Yasumoto ..... G03G 15/161 399/101
2013/0192959 A1 * 8/2013 Kitamura ..... B65H 5/021 198/806
2014/0008184 A1 * 1/2014 Hozumi ..... B65G 15/60 198/806
2014/0183008 A1 * 7/2014 Yasumoto ..... B41J 11/007 198/813
2017/0129725 A1 * 5/2017 Sasaki ..... B65H 5/023

FOREIGN PATENT DOCUMENTS

JP 4742241 B2 8/2011
JP 2013-257483 A 12/2013
JP 2014-130181 A 7/2014
JP 2015-206864 A 11/2015

* cited by examiner

IMAGE FORMING APPARATUS

FIELD OF THE INVENTION AND RELATED ART

The present invention relates to an image forming apparatus including a belt feeding device for feeding an endless belt stretched by a plurality of stretching rollers.

Conventionally, in the image forming apparatus of an electrophotographic type or an electrostatic recording type, the belt feeding device including the endless belt stretched by the plurality of stretching rollers is used. The belt is used as a feeding member for carrying and feeding a toner image or carrying and feeding a recording material on which the toner image is formed. As the feeding member for carrying and feeding the toner image, a belt-shaped electrophotographic photosensitive member (photosensitive belt), an intermediary transfer member (intermediary transfer belt) for carrying and feeding the toner image in order to transfer the toner image from the photosensitive member onto the recording material, and the like member are used. Further, as the feeding member for carrying and feeding the recording material on which the toner image is formed, a recording material feeding member (recording material feeding belt) for carrying and feeding the recording material onto which the toner image is transferred from the photosensitive member is used.

In such a belt feeding device, a problem of "belt shift" such that the belt shifts toward an end portion side of either of the stretching rollers with respect to a rotational axis direction during feeding (traveling) of the belt due to accuracy of outer diameters of the stretching roller, accuracy of relative alignment between the respective stretching rollers, and the like has been known.

Of means for solving the problem of the belt shift, a center alignment mechanism constituted so as to realize steering of a steering roller with a relatively inexpensive constitution in which an electrical part such as a sensor or an actuator is not needed has been proposed (Japanese Laid-Open Patent Application 2014-130181). In this mechanism, a force for swinging (tilting) the steering belt by a sliding member slidable with an inner peripheral surface of a moving belt at each of end portions with respect to a widthwise direction of the belt is imparted to the steering roller, so that center alignment (adjustment of a belt feeding position with respect to a widthwise direction) of the belt is carried out.

However, in the case where lifetime extension or cost reduction of the belt are promoted, the following problem occurs in some cases.

For example, in the case of a constitution in which center alignment of the belt is carried out by sliding between the widthwise end portion of the belt and the sliding member as described above, a load is exerted on the widthwise end portion of the belt. In addition, it turned out that depending on an arrangement of the end portion of the stretching roller with respect to the rotational axis direction, the load concentrates at the widthwise end portion of the belt in some cases (stress concentration). This is particularly conspicuous in the case where end (portion) positions of the respective stretching rollers are aligned.

This stress concentration loads to fatigue failure (crack) of the belt in some cases when an amount of repetitive use of the belt increases, and is a problem when the lifetime extension is promoted. Further, in the case where a thickness of the belt is made thin for reducing the cost of the belt or the like, rigidity of the belt lowers, and therefore, loads to the above-described fatigue failure earlier in some cases.

SUMMARY OF THE INVENTION

A principal object of the present invention is to provide an image forming apparatus capable of alleviating concentration of a load at a widthwise end portion of an endless belt in a constitution including the endless belt stretched by a plurality of states.

According to an aspect of the present invention, there is provided an image forming apparatus comprising: an image forming portion configured to form a toner image; an endless belt which is provided opposed to the image forming portion and onto which the toner image formed on the image forming portion is transferred; and a plurality of stretching rollers configured to stretch the belt; the stretching rollers including, a tiltable steering roller configured to adjust a position of the belt with respect to a widthwise direction; a sliding member provided non-rotatably at a position adjacent to each of ends of the stretching roller with respect to a rotational axis direction, the sliding member being tiltable together with the steering roller and slidable with an inner surface of the belt; a first stretching roller having a smallest diameter of diameters of the stretching rollers excluding the steering roller, and a second stretching roller having a largest diameter of the diameters of the stretching rollers excluding the steering roller, wherein with respect to rotational axis directions of the stretching rollers, lengths of contact portions of the stretching rollers with the belt are shorter than a width of the belt, the length of the contact portion of the first stretching roller with the belt is a first length, the length of the contact portion of the second stretching roller with the belt is a second length shorter than the first length, and end positions of the contact portions of the first and second stretching rollers with respect to the rotational axis direction are different from each other.

Further features of the present invention will become apparent from the following description of exemplary embodiments with reference to the attached drawings.

DESCRIPTION OF THE EMBODIMENTS

An image forming apparatus according to the present invention will be described with reference to the drawings.

Embodiment 1

1. General Structure and Operation of Image Forming Apparatus

Figure 1:
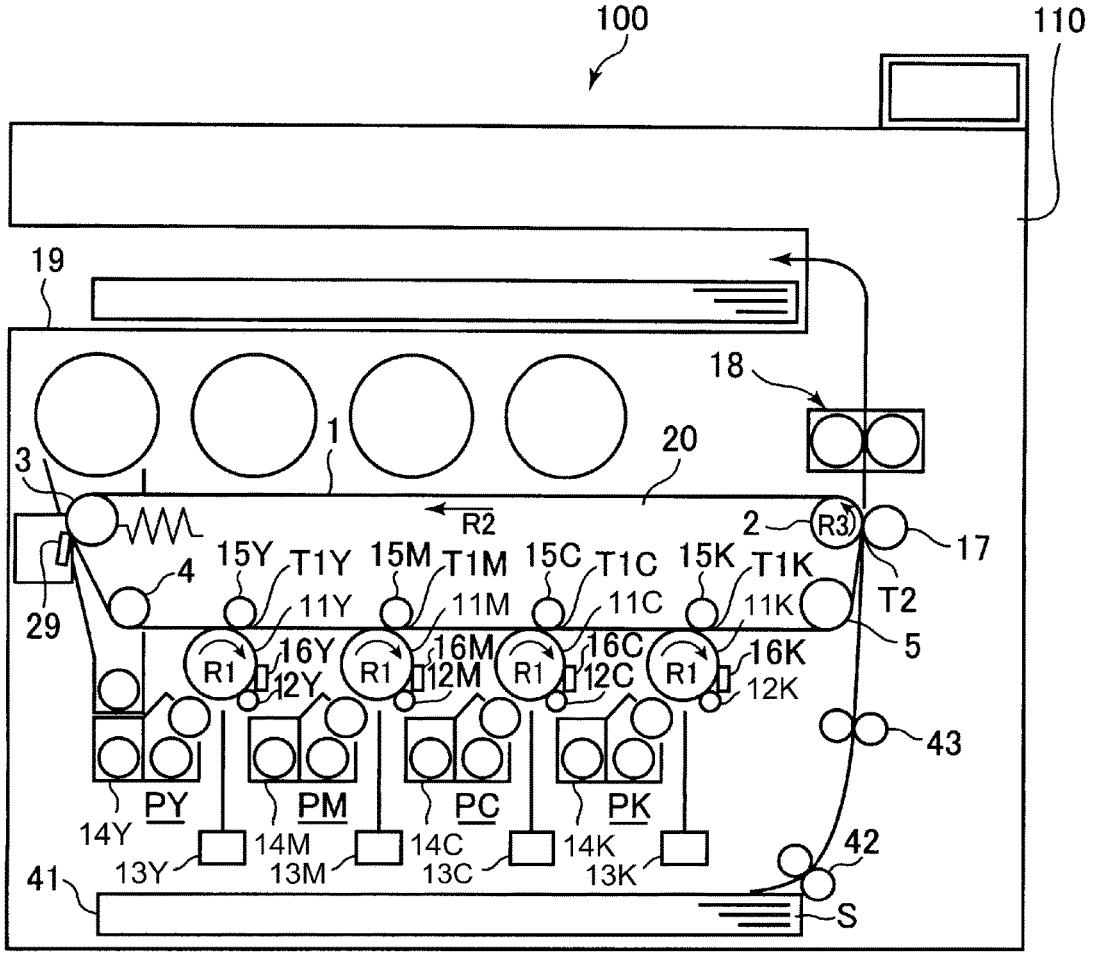
FIG. 1 is a schematic sectional view of an image forming apparatus.

FIG. 1 is a schematic sectional view of an image forming apparatus 100 in this embodiment.

The image forming apparatus 100 in this embodiment is a tandem-type multi-function machine which is capable of forming a full-color image using an electrophotographic type and which employs an intermediary transfer type. The multi-function machine has functions of a copying machine, a printer and a facsimile machine.

The image forming apparatus 100 includes, as a plurality of image forming portions (stations), four image forming portions (stations) PY, PM, PC and PK for forming images of color of yellow (Y), magenta (M), cyan (C) and black (K), respectively. These four image forming portions PY, PM, PC and PK are provided and arranged along a movement direction of an intermediary transfer belt 1 described later. Incidentally, as regards elements having the same or corresponding constitutions in the respective image forming portions PY, PM, PC and PK, suffixes Y, M, C and K for representing the elements for associated colors, respectively, are omitted, and the elements will be collectively described in some cases. In this embodiment, each image forming portion P is constituted by including a photosensitive drum 11, a charging roller 12, an exposure device 13, a developing device 14, a primary transfer roller 15 and a drum cleaning device 16, which are described below.

The image forming apparatus 100 includes, as a first image bearing member, the photosensitive drum 11 which is a drum-shaped (cylindrical) photosensitive member (electrophotographic photosensitive member). The photosensitive drum 11 is rotationally driven in an arrow R1 direction (clockwise direction) in FIG. 1. A surface of the rotating photosensitive drum 11 is electrically charged uniformly to a predetermined polarity (negative in this embodiment) and a predetermined potential by the charging roller 12 which is a roller-shaped charging member as a charging means. The uniformly charged surface of the photosensitive drum 11 is subjected to scanning exposure to laser light modulated depending on an image signal by the exposure device (laser beam scanner) 13 as an exposure means. As a result, an electrostatic latent image (electrostatic image) is formed on the surface of the photosensitive drum 11.

The electrostatic latent image formed on the photosensitive drum 11 is developed (visualized) with toner by the developing device 14 as a developing means. As a result, a visualized image with the toner, i.e., a toner image is formed on the surface of the photosensitive drum 11. In this embodiment, on an exposed portion of the photosensitive drum 11 where an absolute value of the potential is lowered by the exposure to light after the uniform charging of the photosensitive drum surface, the toner charged to the same polarity as the charge polarity (negative in this embodiment) of the photosensitive drum 11 is deposited (reverse development). In the developing device 14, a two-component developer in which toner (non-magnetic toner particles) and a carrier (magnetic carrier particles) are mixed is carried on a developing sleeve as a developer carrying member and is fed to an opposing portion (developing portion) to the photosensitive drum 11. Then, depending on the electrostatic latent image on the photosensitive drum 11, the developing sleeve supplies the toner of the two-component developer to the photosensitive drum 11.

An intermediary transfer belt unit 20 as a belt feeding device is provided so as to oppose the respective photosensitive drums 11 of the respective image forming portions. The intermediary transfer belt unit 20 includes the intermediary transfer belt 1 which is an intermediary transfer member constituted by an endless belt as a second image bearing member. The intermediary transfer belt 1 is extended around, as a plurality of stretching rollers, a driving roller 2, a steering roller 3, an idler roller 4 and an upstream secondary transfer roller (hereinafter referred to as an upstream roller) 5, and is stretched by these stretching rollers with a predetermined tension. The intermediary transfer belt 1 is rotated (circulated and moved) in an arrow R2 direction (counterclockwise direction) in FIG. 1 is rotational drive of the driving roller 2 in an arrow R3 direction (counterclockwise direction) in FIG. 1. In an inner peripheral surface side of the intermediary transfer belt 1, a primary transfer rollers 15 which are roller-shaped primary transfer members as primary transfer means are provided correspondingly to the photosensitive drums 11. Each of the primary transfer rollers 15 is urged (pressed) against the intermediary transfer belt 1 toward the associated photosensitive drum 11. As a result, a primary transfer portion T1 where the photosensitive drum 11 and the intermediary transfer belt 1 are in contact with each other.

The toner images formed on the photosensitive drums 11 as described above are transferred (primary-transferred) onto the intermediary transfer belt 1 at the primary transfer portions T1 under application of a predetermined pressure and an electrostatic load bias by the primary transfer rollers 15. For example, during full-color image formation, the toner images of four colors of yellow, magenta, cyan and black formed on the respective photosensitive drums 11 are successively transferred superposedly onto the intermediary transfer belt 1.

In an outer peripheral surface side of the intermediary transfer belt 1, at a position opposing the driving roller (inner secondary transfer roller) 2, a secondary transfer roller (outer secondary transfer roller) 17 which is a roller-shaped secondary transfer member as a secondary transfer means is provided. The secondary transfer roller 17 is urged (pressed) against the intermediary transfer belt 1 toward the driving roller 2, and forms a secondary transfer portion T2 where the intermediary transfer belt 1 and the secondary transfer roller 17 are in contact with each other.

The toner images formed on the intermediary transfer belt 1 as described above are transferred (secondary-transferred) at the secondary transfer portion T2 onto a recording material S such as paper fed to the secondary transfer portion T2 under application of a predetermined pressure and an electrostatic load bias by the secondary transfer roller 17. The recording material S is stacked and accommodated in an accommodating portion 41, and is fed in synchronism with image formation timing by a feeding roller pair 42 employing a friction separation type. The recording material S fed by the feeding roller pair 42 passes through a feeding pass and is fed to a registration roller pair 43. The recording material S is subjected to oblique movement correction and timing correction by the registration roller pair 43 and thereafter is sent to the secondary transfer portion T2. At the secondary transfer portion T2, the toner images are transferred as described above onto the recording material S nipped and fed by the intermediary transfer belt 1 and the secondary transfer roller 17.

The recording material S on which the toner images are transferred is fed to a fixing device 18 as a fixing means, in which the toner images are heated and pressed and thus is fixed (melt-fixed) on the recording material S, and thereafter, the recording material S is discharged (outputted) onto a discharge tray 19 provided at an outer portion of an apparatus main assembly 110 of the image forming apparatus 100.

Further, toner (primary transfer residual toner) remaining on the surface of each of the photosensitive drums 11 after the primary transfer is removed and collected from the surface of the photosensitive drum 11 by the drum cleaning device 16 as a photosensitive member cleaning means. Further, toner (secondary transfer residual toner) remaining on the of the intermediary transfer belt 1 after the secondary transfer is removed and collected from the surface of the intermediary transfer belt 1 by a belt cleaning device 29 as an intermediary transfer member cleaning means.

In this embodiment, each of the image forming portions P constitutes a toner image forming means for forming the toner image on the intermediary transfer belt 1.

2. Intermediary Transfer Belt Unit

The intermediary transfer belt unit 20 as the belt feeding device in this embodiment will be further described. Incidentally, with regard to the image forming apparatus 100 and elements thereof, a front side on the drawing sheet of FIG. 1 is referred to as a "front" side (surface), and a rear side on the drawing sheet f FIG. 1 is referred to as a "rear" side (surface). This front-rear direction is substantially parallel to a rotational axis direction (longitudinal direction) of the photosensitive drum 1.

Figure 2:
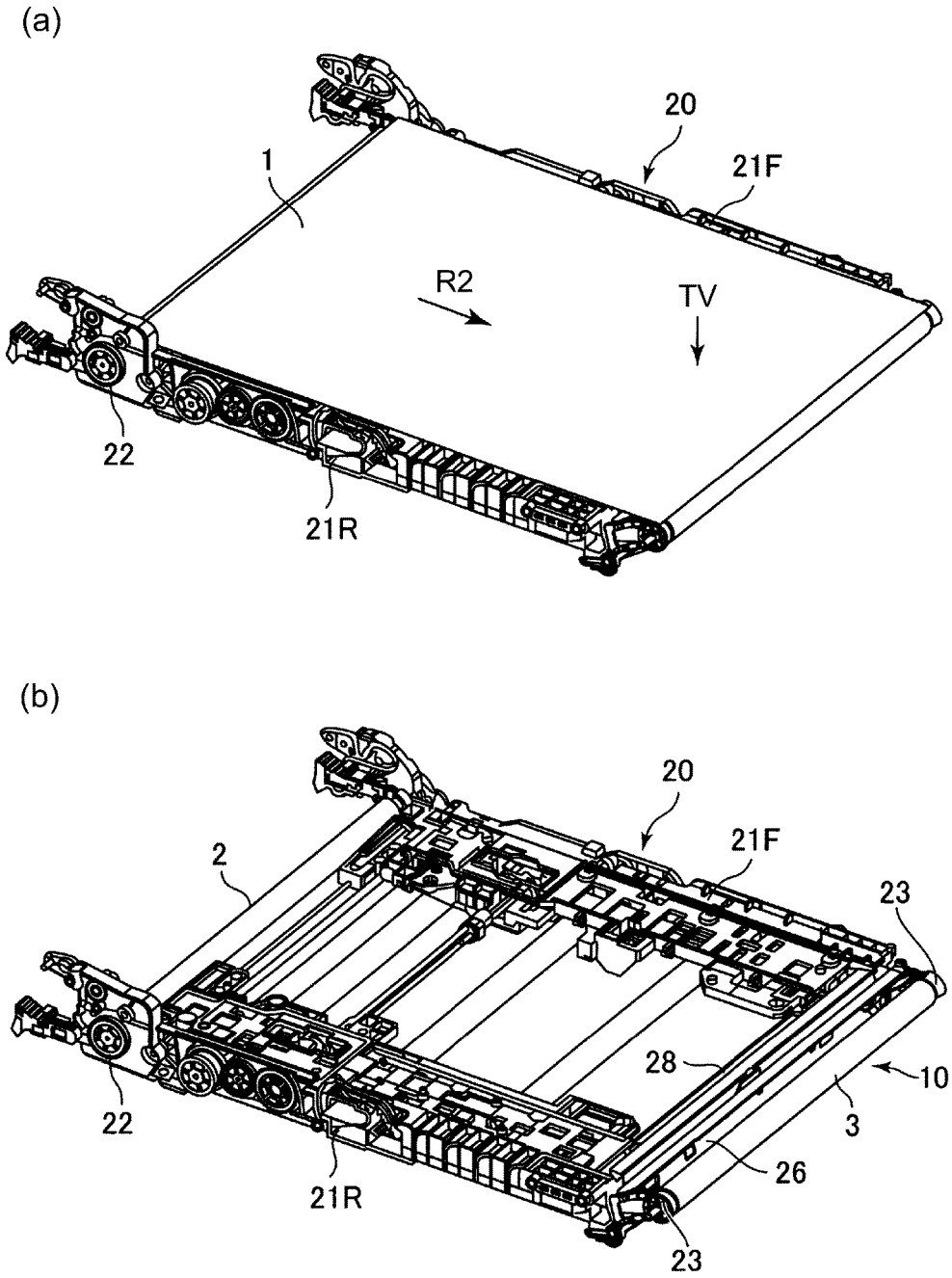
In FIG. 2, (a) and (b) are perspective views of an intermediary transfer belt unit.

In FIG. 2, (a) and (b) are perspective views of the intermediary transfer belt unit 20, in which a rear-side side surface is shown so as to be the front side on the drawing sheet. In FIG. 2, (a) shows a toner in which the intermediary transfer belt 1 is stretched, and (b) shows a state in which the intermediary transfer belt 1 is demounted from the tiltable unit 20.

As shown in (a) and (b) of FIG. 2, each of the driving roller 2, the upstream roller 5 and the idler roller 4 is rotatably shaft-supported at end portions with respect to the rotational axis direction in the form such that the roller is sandwiched between a front frame 21F and a rear frame 21R. The steering roller 3 is, as described specifically later, supported by a frame stay 28 via a swingable plate 26 and is rotatable. The frame stay 28 is extended between the front frame 21F and the rear frame 21R and is fixed at one longitudinal end portion of each of the front frame 21F and the rear frame 21R. As described specifically later, the steering roller 3 is urged by an urging means from the inner peripheral surface side toward the outer peripheral surface side of the intermediary transfer belt 1 and also functions as a tension roller for imparting tension to the intermediary transfer belt 1.

At one end portion of the driving roller 2 with respect to the rotational axis direction, a driving coupling 22 is mounted. To the driving coupling 22, a driving force is transmitted by connecting the driving coupling 22 with an output shaft of a belt driving unit (not shown). The driving roller 2 has a surface constituted by a material, such as a rubber, relatively high in friction coefficient, and the surface thereof friction-engages with the inner peripheral surface of the intermediary transfer belt 1. Then, the driving force is transmitted from the belt driving unit to the driving roller 2, so that the driving roller 2 feeds (rotates) the intermediary transfer belt 1 in the arrow R2 direction in (a) of FIG. 2. In this embodiment, the driving coupling 22 is used as a drive transmitting means, but the driving roller 2 may also be connected with the belt driving unit by using a gear.

In this embodiment, the intermediary transfer belt unit 20 includes an automatic belt center alignment mechanism portion 10 for carrying out center alignment (adjustment of a belt feeding position with respect to a widthwise direction) of the intermediary transfer belt 1 fed as described above. In this embodiment, roughly, the automatic belt center alignment mechanism portion 10 carries out the center alignment of the intermediary transfer belt 1 by self-maintaining a balance of a frictional force between end portions of the steering roller 3 with respect to the rotational axis direction.

3. Automatic Belt Center Alignment Mechanism Portion

Figure 3:
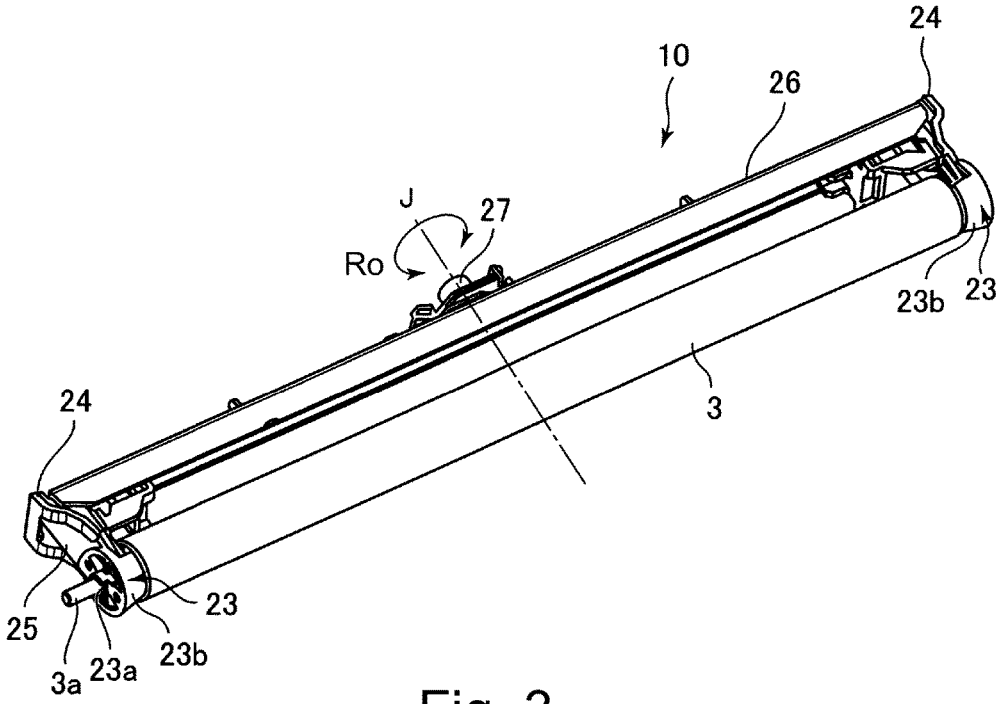
FIG. 3 is a perspective view of an automatic belt center alignment mechanism portion.

The automatic belt center alignment mechanism portion 10 will be described with reference to FIGS. 3 and 4. FIG. 3 is a perspective view of the automatic belt center alignment mechanism portion 10 in this embodiment, and FIG. 4 is an enlarged perspective view of the automatic belt center alignment mechanism portion 10 in the neighborhood of a rear-side end portion.

Figure 4:
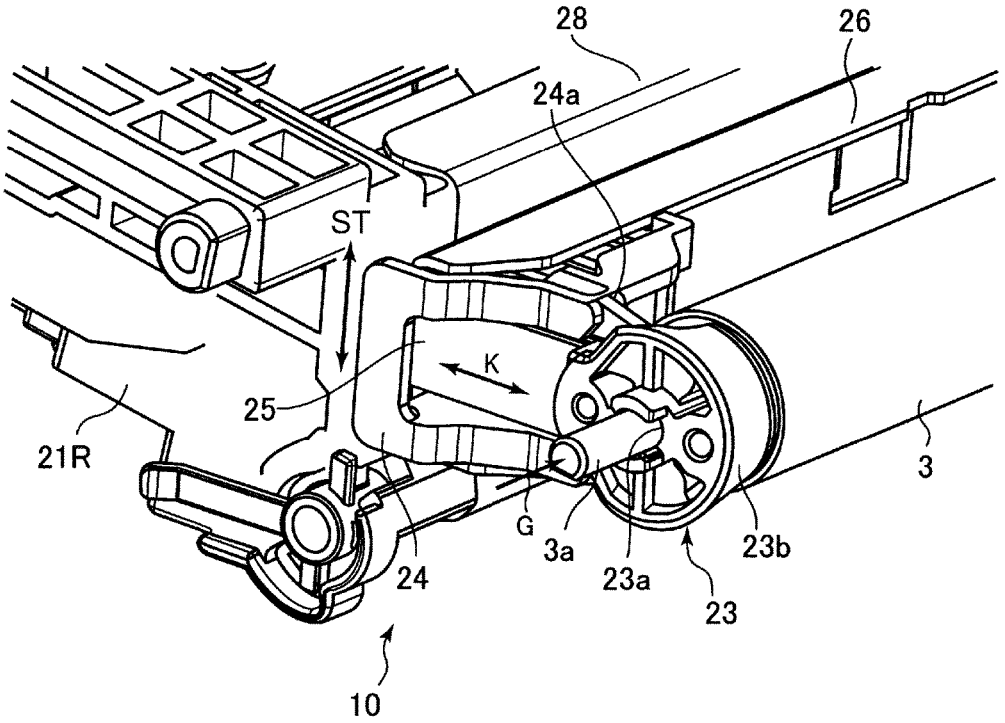
FIG. 4 is an enlarged perspective view of the automatic belt center alignment mechanism portion at an end portion.

As shown in FIGS. 3 and 4, the steering roller 3 includes a roller shaft 3*a* projecting from each of ends with respect to the rotational axis direction thereof. At positions opposing the end portions of the steering roller 3 with respect to the rotational axis direction, sliding members 23 are provided. The roller shafts 3*a* are rotatably shaft-supported by the sliding members 23 at the end portions in the form of being engaged and inserted in supporting holes 23*a* provided in the sliding members 23. These pair of sliding members 23 are mounted to the swingable plate 26 so as to support the end portions of the steering roller 3 with respect to the rotational axis direction. That is, each of the sliding members 23 disposed adjacently to the end portions of the steering roller 3 with respect to the rotational axis direction is supported by a slide guide 24 provided to the swingable plate 26 at an associated one of longitudinal end portions. Between the sliding member 23 and the slide guide 24, a tension spring 25 which is a compression spring is provided in a compressed state.

As shown in FIG. 4, the slide guide 24 includes an engaging groove 24*a* for guiding the associated sliding member 23 only along a pressing (urging) direction (an arrow K direction) of the tension spring 25. That is, the slide guides 24 constitute a guiding portion for guiding the pair of sliding members 23 in the urging direction of the tension spring 25. Further, the sliding guide 24 includes a stopper (not shown) with respect to the pressing direction of the tension spring 25 so that the sliding member 23 is not disengaged in an assembly state (FIG. 3) of the automatic belt center alignment mechanism portion 10 alone. By these constitutions, the urging force of the tension springs 25 disposed at the longitudinal end portions of the swingable plate 26 can be effectively transmitted to the corresponding sliding members 23.

In a state in which the intermediary transfer belt 1 is stretched by the driving roller 2, the steering roller 3, the upstream roller 5 and the idler roller 4 ((a) of FIG. 2), the sliding member 23 moves from a position, where the sliding member 23 is regulated by the stopper, in a direction of compressing the tension spring 25 along an arrow K direction in FIG. 4. Thus, the tension spring 25 urges the steering roller 3 via the sliding member 23, and imparts predetermined tension to the intermediary transfer belt 1. In this embodiment, by this constitution, as described above, the steering roller 3 also functions as the tension roller.

The swingable plate 26 constitutes a swingable member (tiltable member) for swingably (tiltably) supporting the steering roller 3 so as to be capable of changing relative alignment with the driving roller 2. Further, the tension spring 25 constitutes an urging member which is an urging means for applying a tension force, actable on the inner peripheral surface of the intermediary transfer belt 1, to the steering roller 3. In this embodiment, the tension springs 25 comprise a pair of compression springs (spring members) for applying the tension force to the pair of sliding members 23, respectively, at the longitudinal end portions of the swingable plate 26.

As shown in FIG. 3, at a longitudinal central portion of the swingable plate 26, a rotation shaft member 27 is fixed in a state in which the rotation shaft member 27 projects in a side opposite from a side where the steering roller 3 is provided. Further, at the longitudinal end portions of the swingable plate 26, the slide guides 24 are fixed, respectively. The rotation shaft member 27 is engaged with an engaging portion (not shown) provided on the above-described frame stay 28 ((b) of FIG. 2 and FIG. 4), so that the rotation shaft member 27 rotatably (swingably) supports the swingable plate 26 supporting the steering roller 3. That is, the automatic belt center alignment mechanism portion 10 is supported by the frame stay 28 so as to be rotatable in an arrow Ro direction in FIG. 3 with respect to a steering axis J passing through the rotation shaft member 27 provided at the longitudinal central portion of the swingable plate 26. Further, the automatic belt center alignment mechanism portion 10 is constituted as a steering roller supporting unit for supporting the steering roller 3.

As shown in FIG. 4, the pair of sliding members 23 includes sliding surfaces 23*b* slidable with the inner peripheral surface of the moving intermediary transfer belt 1. As described specifically later, by sliding between the inner peripheral surface of the intermediary transfer belt 1 and the sliding surfaces 23*b*, a force for changing relative alignment between the steering roller 3 and the driving roller 2 for the purpose of carrying cut the center alignment of the intermediary transfer belt 1 is applied to the steering roller 3. Each of the sliding surfaces 23*b* is formed in a tapered shape such that a distance thereof from the outer peripheral surface of the steering roller 3 with respect to a radial direction gradually increases from a central portion side toward an end portion side of the steering roller 3 with respect to the rotational axis direction. As a result, a function of automatically carrying out the center alignment of the intermediary transfer belt 1 can be further enhanced.

In this embodiment, an outer diameter of the steering roller 3 is set at φ16 (16 mm), for example. The sliding surface 23*b* of the sliding member 23 has a curved surface portion having a curved shape of φ16 in outer diameter equal to the outer diameter of the steering roller 3, at the end portion in a side where the sliding surface 23*b* is adjacent to the end portion of the steering roller 3 with respect to the rotational axis direction. Further, the sliding surface 23*b* has a shape such that a diameter thereof gradually increases from the side adjacent to the end portion of the steering roller 3 toward the end portion thereof with respect to the rotational axis direction with a ratio of 10° in taper angle Ψ increasing from the curved surface portion of φ16 ((b) of FIG. 5).

Figure 5:
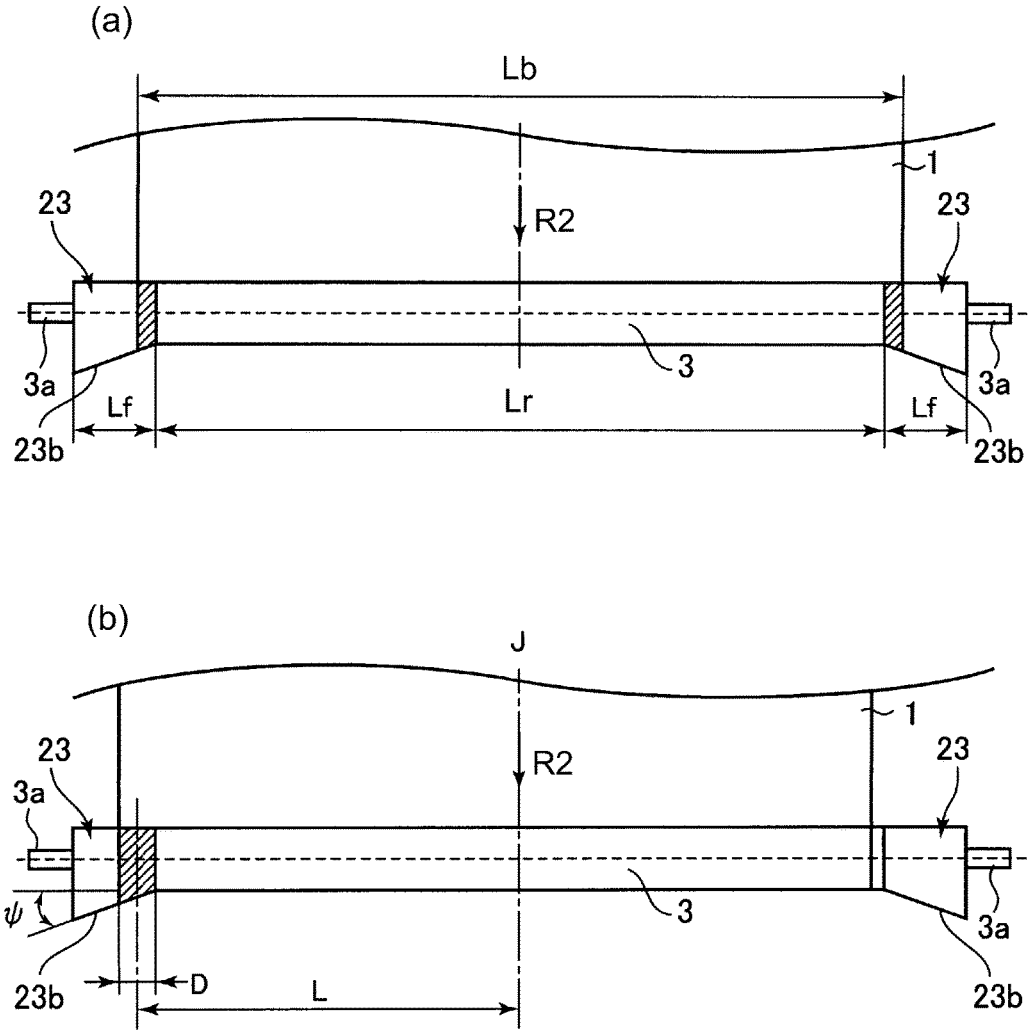
In FIG. 5, (a) and (b) are schematic views for illustrating an operating principle of the automatic belt center alignment mechanism portion.

In this embodiment, a width (length with respect to a direction substantially perpendicular to the feeding direction shown by the arrow R2 in FIG. 5) of the intermediary transfer belt 1 is set so as to partly extend to a region of the sliding surface 23*b* having the taper angle Ψ. The sliding member 23 has the degree of freedom through the sliding guide 24 only with respect to the arrow K direction in FIG. 4 as described above. For that reason, when the intermediary transfer belt 1 is fed (rotated), the sliding member 23 simply slides with the inner peripheral surface of the intermediary transfer belt 1 without being rotated by the rotation of the intermediary transfer belt 1. Incidentally, the sliding member 23 may also have play with respect to the belt rotational direction.

An operational principle of the automatic belt center alignment mechanism portion 10 will be described with reference to FIGS. 4 and 5. In FIG. 5, (a) and (b) are plan views (top views) showing a part of the intermediary transfer belt unit in a state as seen in an arrow TV direction in FIG. 2, in which (a) shows a steady state of balance by the automatic center alignment that a winding position of the intermediary transfer belt 1 is a nominal (center) position, and (b) shows a state in which when the intermediary transfer belt 1 is fed, the intermediary transfer belt 1 caused belt shift toward a left side on the drawing sheet.

As described above, the sliding members 23 are supported so as not to be rotated by the intermediary transfer belt 1. Further, the sliding members 23 is always subjected to frictional resistance from the inner peripheral surface of the intermediary transfer belt 1 when the intermediary transfer belt 1 is fed. That is, in this embodiment, a dimensional relationship among the intermediary transfer belt 1, the steering roller and the sliding members 23 is as follows. As shown in (a) of FIG. 5, a width of the intermediary transfer belt 1 is Lb. Further, a length (width) of a contact portion of the steering roller 3 with the intermediary transfer belt 1 with respect to the rotational axis direction is Lr. Further, a width of the sliding surface 23*b* of the sliding member 23 with respect to the rotational axis direction of the steering roller 3 is Lf. At this time, in this embodiment, Lb is set so as to be longer than Lr and so as to shorter than Lr+2Lf (width between outer ends of the sliding surfaces 23*b* of the sliding members 23 with respect to the rotational axis direction of the steering roller 23).

In the state in which the intermediary transfer belt 1 is in the nominal (center) position shown in (a) of FIG. 5, the intermediary transfer belt 1 always slides with both of the sliding members 23 with a predetermined winding width (e.g., 2 mm in this embodiment). Thus, the intermediary transfer belt 1 and the pair of sliding members 23 provide the following positional relationship in a state in which the intermediary transfer belt 1 is uniformly positioned on the basis of the center of the steering roller 3 with respect to the rotational axis direction. That is, the positional relationship is such that both of the end portions of the intermediary transfer belt 1 with respect to a widthwise direction partly cover the associated sliding surfaces 23*b* of the pair of sliding members 23. Accordingly, at least one of the widthwise end portions of the intermediary transfer belt 1 always contacts the sliding member(s) 23 irrespective of a widthwise feeding position of the intermediary transfer belt 1.

On the other hand, in a state in which the belt shift generated as shown in (b) of FIG. 5, a winding width relationship between the intermediary transfer belt 1 and the sliding member 23 in a state in which the winding width is localized as being a winding width D only in a left side on the drawing sheet. In this state, the sliding members 23 receive a force of F(ST)×D in the left side and a force of 0 in the right side in a downward direction (toward the rear side on the drawing sheet of FIG. 5) along an arrow ST direction in FIG. 4. A difference in frictional forces of the pair of sliding members 23 in both sides is a motive force for generating moment (steering torque) F(ST)×D about the steering axis J. That is, in the state of (b) of FIG. 5, the moment F(ST)×D about the steering axis J generates in a direction in which the left side where the belt shift generated lowers along the arrow ST direction in FIG. 4. Also the case where the belt generated in the right side on the drawing sheet contrary to the case of 8*b*) of FIG. 5 is similar to the case of (b) of FIG. 5. In that case, the moment F(ST)×D about the steering axis J generates in a direction in which the right side where the belt shift generated lowers along the arrow ST direction in FIG. 4.

A direction of the steering angle of the steering roller 3 generated on the basis of the above-described principle coincides with a direction in which the belt shift is eliminated (i.e., the belt position is returned to the original position), and therefore, an automatic center alignment effect can be obtained.

In the case of the endless belt, as in the case of the intermediary transfer belt 1, relating to the image forming process, a change in widthwise feeding position of the intermediary transfer belt 1 caused by an abrupt steering operation invites a positional deviation of the images with respect to a main scan direction (rotational axis direction of the photosensitive drums 1). That is, in the image forming apparatus 1 in this embodiment, relative positional deviation of the respective color images during the color image formation leads to color misregistration. Therefore, in this embodiment, the taper angle Ψ is provided to the sliding member 23 and a friction coefficient μS between the intermediary transfer belt 1 and the sliding member 23 is set at a relative low value, so that the abrupt steering operation is suppressed. Specifically, a good result can be obtained by using a resin material, such as POM (polyacetal) having a good sliding property, as a material of the sliding member 23 and by setting the friction coefficient μS at about 0.3 and the taper angle Ψ at about 5°-10°. Further, in consideration of an electrostatically adverse effect due to triboelectric charge with the intermediary transfer belt 1, also electroconductivity is imparted to the sliding members 23.

Further, also the dimensional relationship among the intermediary transfer belt 1, the smallest roller 3 and the sliding members 23 in this embodiment as shown in (a) of FIG. 5 is advantageous in suppressing the abrupt steering operation causing the above-described color misregistration. This is because in the dimensional relationship of (a) of FIG. 5, a difference in balance between the frictional forces can be always detected and therefore it becomes possible to perform a frequent center alignment operation.

4. Width/Diameter Relationship Among Stretching Rollers

Figure 6:
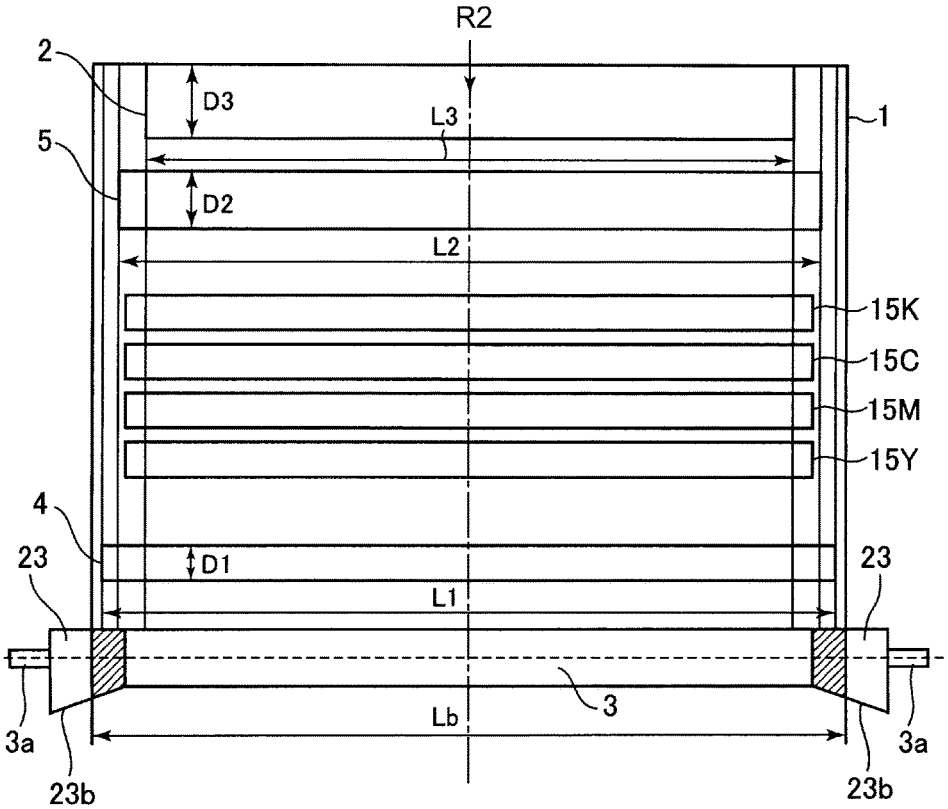
FIG. 6 is a schematic view for illustrating width and diameter relationships among stretching rollers.

With reference to FIG. 6, a relationship between end portion positions of the plurality of stretching rollers with respect to the rotational axis direction and diameters of the stretching rollers in this embodiment will be described.

Here, the diameter of the idler roller 4 is D1, and a length of a contact portion of the idler roller 4 with the intermediary transfer belt 1 with respect to the rotational axis direction (hereinafter referred to as a "contact portion width") is L1. Further, the diameter of the upstream roller 5 is D2, and the contact portion width of the upstream roller 5 is L2. Further, the diameter of the driving roller 2 is D3, and the contact portion width of the driving roller 2 is L3. Incidentally, each of the driving roller 2, the upstream roller 5 and the idler roller 4 has a line-symmetrical shape with respect to the steering axis J (nominal center line of the widthwise feeding position of the intermediary transfer belt 1). Further, the diameter of each of the stretching rollers is a diameter of the contact portion of the stretching roller with the intermediary transfer belt 1.

As described above, in this embodiment, the center alignment of the intermediary transfer belt 1 is carried out by generating friction at each of the widthwise end portions of the intermediary transfer belt 1. For that reason, on overlapping portions (hatched portions in FIGS. 5 and 6) which are regions where the sliding members 23 provided at the widthwise end portions of the intermediary transfer belt 1 slide with the intermediary transfer belt 1, a load due to the friction is exerted. Further, in this embodiment, the above-described contact portion widths L1, L2 and L3 are shorter than a width Lb of the intermediary transfer belt 1, and therefore on the widthwise end portions of the intermediary transfer belt 1, also loads by the end portions of the idler roller 4, the upstream roller 5 and the driving roller 2 with respect to the rotational axis direction are exerted.

Further, in the case where the end portion positions of the idler roller 4, the upstream roller 5 and the driving roller 2 are aligned with each other (L1=L2=L3), when the end portion positions and the above-described overlapping portions overlap with each other, the loads concentrate at the widthwise end portions of the intermediary transfer belt 1. That is, in this case, at the widthwise end portions of the intermediary transfer belt 1, in addition to the load by the friction with the sliding members 23, the loads due to stress concentration at the end portions of the stretching rollers generate with feeding of the intermediary transfer belt 1. Further, when an amount of repetitive use of the intermediary transfer belt 1 increases, it leads to fatigue failure (breakdown) of the intermediary transfer belt 1 in some cases.

Therefore, in this embodiment, the contact portion widths L1, L2 and L3 of the idler roller 4, the upstream roller 5 and the driving roller 2, respectively, are changed depending on the diameters of these stretching rollers, respectively.

That is, when the intermediary transfer belt 1 is stretched with predetermined tension, at positions where the intermediary transfer belt 1 contacts the associated end portions of the stretching rollers, a value of stress increases with a decreasing diameter of the stretching rollers. On the other hand, line pressure (force per unit width) exerted on the intermediary transfer belt 1 by the stretching roller decreases when an increasing contact portion width of the stretching roller. Accordingly, with the decrease in line pressure by increasing the contact portion width of the stretching roller, it is possible to reduce the value of the stress exerted on the position where the intermediary transfer belt 1 contacts the end portion of the stretching roller.

Thus, in this embodiment, not only the end portion position of the stretching rollers are simply shifted from each other, but also the contact portion widths of the stretching rollers are increased with a decreasing diameter of the stretching rollers. As a result, at the position where the stress is liable to concentrate due to the small diameter of the stretching roller, stress relaxation is preferentially performed, so that it is possible to realize lifetime extension of the intermediary transfer belt 1.

Specifically, in this embodiment, the diameters D2, D2 and D1 of the driving roller 2, the upstream roller 5 and the idler roller 4, respectively, provide a relationship of D3>D2>D1. Accordingly, in this embodiment, the contact portion widths L3, L2 and L1 of the driving roller 2, the upstream roller 5 and the idler roller 4, respectively, are constituted so as to provide a relationship of L3<L2<L1. As a result, a smaller diameter stretching roller liable to cause the stress concentration can be preferentially subjected to the stress relaxation while shifting the end portion positions (i.e., positions where the stress concentration generate) of the driving roller 2, the upstream roller 5 and the idler roller 4.

In this embodiment, the reason why the diameters D3, D2 and D1 of the driving roller 2, the upstream roller 5 and the idler roller 4 provide the relationship of D3>D2>D1 is as follows.

First, in this embodiment, the driving roller 2 is a drive input means to the intermediary transfer belt 1. In order to suppress overlapping failure (color misregistration) of the toner images at the secondary transfer portion T2, a pitch (rotation center distance) Ld between adjacent photosensitive drums 11 may preferably be an integer multiple of a circumferential length (D3×π) of the driving roller 2 having the diameter D3. For example, in the case where the pitch Ld between the photosensitive drums 11 is 100 mm, the diameter D3 of the driving roller 2 is constituted to satisfy D3=31.84 mm or D3=15.92 mm. Accordingly, for example, in the intermediary transfer belt unit 20 used in the image forming apparatus 100 having the above-described pitch Ld, of the stretching rollers including the driving roller 2, the upstream roller 5 and the idler roller 4, the driving roller 2 is liable to have a largest diameter. Further, in order to form the secondary transfer portion T2 by the pressing force (pressure) of the secondary transfer roller 17 opposing the driving roller 2, the pressing force of, e.g., about 5-10 kgf acts on the driving roller 2. In order to suppress deformation by this pressing force, of the stretching rollers including the driving roller 2, the upstream roller 5 and the idler roller 4, the driving roller 2 is made largest in diameter.

Next, the upstream roller 5 forms a primary transfer surface between itself and the idler roller 4 disposed upstream thereof with respect to the feeding direction of the intermediary transfer belt 1, and forms a secondary transfer surface between itself and the driving roller 2 disposed downstream thereof with respect to the feeding direction of the intermediary transfer belt 1. The primary transfer surface is a stretched surface (flat surface portion) of the intermediary transfer belt 1 where the toner images are transferred from the respective photosensitive drums 11 onto the intermediary transfer belt 1, and the secondary transfer surface is a stretched surface (flat surface portion) of the intermediary transfer belt 1 immediately before the toner images are transferred from the intermediary transfer belt 1 onto the recording material S. For that reason, on the upstream roller 5, the pressing force or the like as in the case of the driving roller 2 does not act, but in the case where the upstream roller 5 is deformed, the influence on the image is large, and therefore, the diameter of the upstream roller 5 is made large subsequently to the driving roller 2.

Finally, the idler roller 4 forms the primary transfer surface between itself and the upstream roller 5 disposed downstream thereof with respect to the feeding direction of the intermediary transfer belt 1, but forms only one stretched surface having the influence on the image, and therefore a degree of the influence on the image is small compared with the upstream roller 5.

For that reason, a degree of necessity for the idler roller 4 to have a large diameter is low relative to the driving roller 2 and the upstream roller 5, so that the diameter of the idler roller 4 is smaller from the viewpoint of cost reduction or the like.

When a part cost or the like is taken into consideration, it is desirable that all of the stretching rollers are made small in diameter, but the stretching rollers are made large in diameter depending on function in some cases. In this embodiment, for the above-described reason, the diameters of the driving roller 2, the upstream roller 5 and the idler roller 4 provide the relationship of D3>D2>D1.

Incidentally, the stretching rollers are rotatably supported with play in general. For this reason, in order to prevent overlapping between the end portion positions of the stretching rollers with movement of the stretching rollers due to the play with respect to the rotational axis direction, it is desired that differences (L1−L2 and L2−L3) between the contact portion widths L1 and L2 are between the contact portion widths L2 and L3 are made sufficiently large. In this embodiment, the difference between L1 and L2 and between L2 and L3 may preferably be 2 mm or more, for example.

Thus, in this embodiment, the image forming apparatus 100 includes the intermediary transfer belt 1 and the plurality of stretching rollers, for stretching the intermediary transfer belt 1, including the steering roller 3 tiltable for adjusting the widthwise feeding position of the intermediary transfer belt 1.

Further, of the plurality of stretching rollers, with respect to n stretching rollers (n: integer of two or more) other than the steering roller and shorter in length of the contact portion thereof with the belt 1 with respect to the rotational axis direction than the width of the belt 1 with respect to the rotational axis direction, the following constitution is employed. When an n-th stretching roller is Dn in diameter and Ln in length of the contact portion of the n-th stretching roller, in a case that Dn is larger with an increasing n, Ln is smaller with the increasing n. Further, end positions of the contact portions of the n stretching rollers with respect to the rotational axis direction are different from each other. In this embodiment, of the n stretching rollers, the stretching roller having the largest diameter is the stretching roller for transmitting drive (driving force) to the belt 1. Particularly, in this embodiment, the n stretching rollers are constituted by at least three stretching rollers. Further, of the n stretching rollers, the stretching roller having the largest diameter is the stretching roller for forming the transfer portion T2 where the toner images are transferred from the belt 1 onto the recording material S. Further, of the n stretching rollers, the stretching roller having the second largest diameter is the stretching roller for forming the stretched surface (secondary transfer surface) of the belt 1 between itself and the stretching roller having the largest diameter. Further, of the n stretching rollers, the stretching roller having the third largest diameter is the stretching roller for forming the stretched surface (primary transfer surface) of the belt 1, where the toner images are formed by the toner image forming means, between itself and the stretching roller having the second largest diameter. Further, in this embodiment, the belt feeding device 20 includes the sliding members 23, disposed at the end portions of the steering roller 3 with respect to the rotational axis direction, for imparting the force for tilting the steering roller 3 to the steering roller 3 while sliding with the moving belt 1.

Incidentally, when the n stretching rollers are arbitrarily selected from the plurality of stretching rollers and satisfy the above-described relationship, a corresponding effect of relaxing the concentration of the load at the belt 1 can be obtained. Accordingly, the plurality of stretching rollers for stretching the belt 1 may also include the stretching roller not satisfying the above-described relationship. For example, in the case where as the n stretching rollers, the driving roller 2 of D3 in diameter and L3 in contact portion in width and the idler roller 4 of D1 in diameter and L1 in contact portion width are selected, a relationship of L3<L1 is satisfied when D3>L1 is satisfied. Further, the diameter D2 of the upstream roller 5 satisfies a relationship of D3>D2>D1, for example. In this case, even when the contact portion width L2 of the upstream roller 5 satisfies a relationship of L2=L1 and L2=L3, for example, end portion positions of the driving roller 2 and the idler roller 4 are shifted depending on the diameters, so that a relaxing effect of the load on the belt 1 can be obtained correspondingly. In addition to the constitution of this embodiment, this is true for also a constitution or the like in which a stretching roller having an arbitrary contact portion width is further added. In the present invention, the stretching roller refers to a roller having a winding angle (FIG. 7), about the intermediary transfer belt 1, of 10° or more.

As described above, according to this embodiment, a degree of the stress concentration due to the stretching rollers is relaxed (alleviated) and thus lifetime extension of the intermediary transfer belt 1 can be realized while realizing stable traveling (movement) of the intermediary transfer belt 1 by the automatic belt center alignment mechanism portion 10. Further, even in the case where a thickness of the intermediary transfer belt 1 is made thin for the purpose of cost reduction or the like, it becomes possible to suppress fatigue failure due to a lowering in rigidity of the intermediary transfer belt 1.

Embodiment 2

Another embodiment of the present invention will be described. Basic constitutions and operations of a belt feeding device and an image forming apparatus in this embodiment are the same as those in Embodiment 1. Accordingly, in this embodiment, elements having the same or corresponding functions and constitutions as those in Embodiment 1 are represented by the same reference numerals or symbols, and will be omitted from detailed description.

Figure 7:
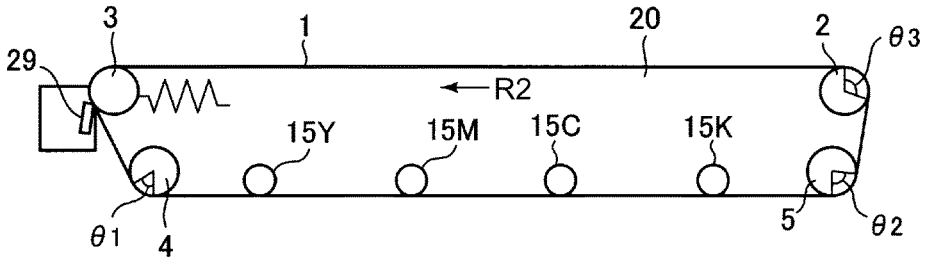
FIG. 7 is a schematic sectional view showing an intermediary transfer belt unit in another embodiment.

FIG. 7 is a schematic sectional view of an intermediary transfer belt unit 20 in this embodiment. In this embodiment, a winding angle of the intermediary transfer belt 1 about the idler roller 4 is θ1. Further, a winding angle of the intermediary transfer belt 1 about the upstream roller 5 is θ2. Further, a winding angle of the intermediary transfer belt 1 about the driving roller 2 is θ3. The winding angle refers to an angle (in a side corresponding to a region where the belt is wound about the associated roller) formed between lines drawing from a contact start position and a contact end position of the intermediary transfer belt 1 with the surface of the associated stretching roller with respect to the feeding direction of the intermediary transfer belt 1 to a rotation center of the associated stretching roller. In this embodiment, similarly as in Embodiment 1, the diameters of the idler roller 4, the upstream roller 5 and the driving roller 2 are D1, D2 and D3, respectively, and the contact portion widths of the idler roller 4, the upstream roller 5 and the driving roller 2 are L1, L2 and L3, respectively.

As described in Embodiment 1, in consideration of the part cost or the like, it would be considered that the relationship of D3=D2=D1 is satisfied. In this case, an effect similar to that in Embodiment 1 can be obtained by changing the contact portion widths L1, L2 and L3 of the idler roller 4, the upstream roller 5 and the driving roller 2 depending on the winding angles of the intermediary transfer belt 1 about the respective stretching rollers. This is because when the winding angle is large, the intermediary transfer belt 1 is subjected to large stress concentration by the end portions of the stretching rollers.

As shown in FIG. 7, in this embodiment, a constitution providing relationships of D3=D2=D1 and θ3>θ2>θ1 is employed. Accordingly, in this embodiment, a relationship of L3>L2>L1 is satisfied. As a result, a stretching roller, having a larger winding angle, liable to cause the stress concentration can be preferentially subjected to the stress relaxation while shifting the end portion positions (i.e., positions where the stress concentration generate) of the driving roller 2, the upstream roller 5 and the idler roller 4.

Incidentally, the winding angles can be set by an arrangement of the respective stretching rollers. The winding angles θ3, θ2 and θ1 of the intermediary transfer belt 1 about the driving roller 2, the upstream roller 5 and the idler roller 4, respectively, satisfy the relationship of θ3>θ2>θ1 for the same reason as that the diameters are changed in Embodiment 1, for example. That is, the driving roller 2 is a drive input means to the intermediary transfer belt 1, and therefore provides a largest winding angle in some cases in order to satisfactorily ensure the transmission of the driving force. Further, the upstream roller 5 is configured to provide the second largest winding angle after the driving roller 2 in some cases in order to stabilize the first transfer surface and the second transfer surface. Further, the idler roller 4 has a small influence on the image compared with the driving roller 2 and the upstream roller, and therefore is made small in winding angle compared with the driving roller 2 and the upstream roller 5.

Thus, in this embodiment, of the plurality of stretching rollers, with respect to n stretching rollers shorter in length of the contact portion thereof with the belt 1 with respect to the rotational axis direction than the width of the belt 1 with respect to the rotational axis direction, the following constitution is employed. When an n-th stretching roller is θn in winding angle of the belt 1 about the roller and Ln in length of the contact portion of the n-th stretching roller, in a case that θn is larger when the n stretching rollers have the substantially same diameter and n is larger, Ln is larger with the increasing n. Further, end positions of the contact portions of the n stretching rollers with respect to the rotational axis direction are different from each other. In this embodiment, of the n stretching rollers, the stretching roller having the largest winding angle is the stretching roller for transmitting drive (driving force) to the belt 1. Particularly, in this embodiment, the n stretching rollers are constituted by at least three stretching rollers. Further, of the n stretching rollers, the stretching roller having the largest winding angle is the stretching roller for forming the transfer portion T2 where the toner images are transferred from the belt 1 onto the recording material S. Further, of the n stretching rollers, the stretching roller having the second largest winding angle is the stretching roller for forming the stretched surface (secondary transfer surface) of the belt 1 between itself and the stretching roller having the largest winding angle. Further, of the n stretching rollers, the stretching roller having the third largest winding angle is the stretching roller for forming the stretched surface (primary transfer surface) of the belt 1, where the toner images are formed by the toner image forming means, between itself and the stretching roller having the second largest winding angle.

As described above, even in the case where the diameters of the stretching rollers are substantially the same, an effect similar to that in Embodiment 1 can be obtained by changing the contact portion widths depending on the winding angles. Incidentally, the substantially same diameter refers to diameters providing a diameter ratio therebetween of 10% or less.

OTHER EMBODIMENTS

The present invention was described above based on the specific embodiments, but is not limited to the above-described embodiments.

In the above-described embodiments, the case where the belt is the intermediary transfer member was described, but the present invention is not limited thereto. For example, an image forming apparatus of a direct transfer type including a recording material carrying belt (feeding belt), for carrying and feeding the recording material, used in place of the intermediary transfer belt in the above-described embodiment has been well known in the field of the present invention. In the image forming apparatus of the direct transfer type, for example, toner images formed at a plurality of image forming portions are successively transferred onto the recording material carried and fed by the recording material carrying belt as a recording material carrying member constituted by an endless belt. Also as regards the recording material carrying belt, it is possible to provide the sliding members in order to carry out the center alignment, and in that case, a problem similar to that, in the above-described embodiments, relating to the intermediary transfer belt can generate. Accordingly, also in the case where the belt is the recording material carrying belt, by applying the present invention thereto, it is possible to achieve an effect similar to those in the above-described embodiments. Similarly, the belt may also be a photosensitive (member) belt, an electrostatic recording dielectric (member) belt, or the like.

Further, in the above-described embodiments, the sliding members were disposed adjacently to the end portions of the steering roller. However, it is also possible to employ other constitutions, in which the sliding member is provided in only one end portion side of the steering roller with respect to the rotational axis direction, such as the case where it has been known that there is a tendency that the belt shifts toward one widthwise end portion side or the case where the belt is intentionally constituted so as to have the tendency that the belt shifts toward one end portion side.

According to the present invention, in the constitution including the endless belt stretched by the plurality of stretching rollers, the concentration of the load at the widthwise end portions of the belt can be alleviated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-062831 filed on Mar. 25, 2016, which is hereby incorporated by reference herein in its entirety.

What is claimed is:

1. An image forming apparatus comprising:

an endless belt;

a primary transfer roller contacting an inner surface of said endless belt and configured to transfer a toner image onto said endless belt at a primary transfer portion;

a secondary transfer roller contacting an outer surface of said endless belt and configured to transfer the toner image from said endless belt onto a recording material at a secondary transfer portion;

a steering unit configured to adjust a position of said endless belt with respect to a widthwise direction of said endless belt, said steering unit including: (a) a steering roller (i) being rotatable about a first rotational axis, (ii) being tiltable about a steering axis crossing the first rotational axis, and (iii) having a first end and a second end with respect to the first rotational axis; (b) a first sliding member adjacent to said first end of said steering roller; and (c) a second sliding member adjacent to said second end of said steering roller, wherein said first and second sliding members are slidable with an inner surface of said endless belt;

a first stretching roller contacting the inner surface of said endless belt and configured to stretch said endless belt, said first stretching roller being located upstream of the primary transfer portion and downstream of a contact portion between said steering roller and said endless belt with respect to a rotational direction of said endless belt, said first stretching roller (i) being rotatable about a second rotational axis, (ii) having a first play with respect to the second rotational axis, and (iii) having a first outer diameter, a contact portion between said first stretching roller and said endless belt with respect to the widthwise direction of said endless belt being a first contact portion having a first contact length; and a second stretching roller contacting the inner surface of said endless belt and configured to stretch said endless belt, said second stretching roller being upstream of the first contact portion and downstream of the primary transfer portion with respect to the rotational direction of said endless belt, said second stretching roller (i) being rotatable about a third rotational axis, (ii) having a second play with respect to the third rotational axis, and (iii) having a second outer diameter larger than the first outer diameter, a contact portion between said second stretching roller and said endless belt with respect to the widthwise direction of said endless belt being a second contact portion having a second contact length, which is smaller than the first contact length, wherein, with respect to the widthwise direction of said endless belt, end portions of the first contact portion within the first play are outside end portions of the second contact portion within the second play.

2. An image forming apparatus according to claim 1, further comprising a third stretching roller configured to stretch said endless belt, said third stretching roller forming the secondary transfer portion between itself and said secondary transfer roller with said endless belt therebetween, said third stretching roller (i) being rotatable about a fourth rotational axis, (ii) having a third play with respect to the fourth rotational axis, and (iii) having a third outer diameter, larger than the first outer diameter, a contact portion between the third stretching roller and said endless belt with respect to the widthwise direction of said endless belt being a third contact portion having a third contact length, which is smaller than the first contact length, wherein, with respect to the widthwise direction of said endless belt, end portions of the third contact portion within the third play are outside end portions of the first contact portion within the first play, and wherein, with respect to the widthwise direction of said endless belt, end portions of the third contact portion within the third play are outside end portions of the second contact portion within the second play.

3. An image forming apparatus according to claim 2, wherein the second outer diameter and the third outer diameter are substantially equal to each other, and wherein each of said second stretching roller and said third stretching roller has a winding angle of said endless belt, the one of said second stretching roller and said third stretching roller with a larger winding angle having a smaller contact width with said endless belt, with respect to the widthwise direction of said endless belt, than the other stretching roller.

4. An image forming apparatus according to claim 2, wherein the one of said second stretching roller and said third stretching roller having a larger outer diameter has a smaller contact length with said endless belt, with respect to the widthwise direction of said endless belt, than the other stretching roller.

5. An image forming apparatus according to claim 1, further comprising a plurality of stretching rollers including said first stretching roller and said second stretching roller, wherein each stretching roller of the plurality of stretching rollers has (i) an outer diameter of Dn and (ii) a contact length of the respective stretching roller with said endless belt with respect to the widthwise direction of said endless belt of Ln, n being an integer indicating the n-th stretching roller, wherein, as n increases, Ln increases and Dn decreases, wherein each stretching roller of the plurality of stretching rollers has an n-th play with respect to a rotational axis direction of a rotation axis of the corresponding stretching roller, and wherein each stretching roller of the plurality of stretching rollers is disposed so that end portions of said stretching rollers are nonoverlapping with each other within the respective amounts of play of said stretching rollers.

6. An image forming apparatus according to claim 1, wherein said second stretching roller is upstream of the secondary transfer portion and downstream of the primary transfer portion with respect to the rotational direction of said endless belt.

7. An image forming apparatus according to claim 1, wherein said second stretching roller is a driving roller configured to drive said endless belt.

8. An image forming apparatus according to claim 1, wherein said second stretching roller forms the secondary transfer portion.

9. An image forming apparatus comprising:

an endless belt;

a primary transfer roller contacting an inner surface of said endless belt and configured to transfer a toner image onto said endless belt at a primary transfer portion;

a secondary transfer roller contacting an outer surface of said endless belt and configured to transfer the toner image from said endless belt onto a recording material at a secondary transfer portion;

a first stretching roller contacting the inner surface of said endless belt and configured to stretch said endless belt, said first stretching roller being located upstream of the primary transfer portion and downstream of the secondary transfer portion with respect to a rotational direction of said endless belt, said first stretching roller (i) being rotatable about a first rotational axis, (ii) having a first play with respect to the first rotational axis, and (iii) having a first outer diameter, a contact portion between said first stretching roller and said endless belt with respect to the widthwise direction of said endless belt being a first contact portion having a first contact length; and a second stretching roller contacting the inner surface of said endless belt and configured to stretch said endless belt, said second stretching roller being upstream of the secondary transfer portion and downstream of the primary transfer portion with respect to the rotational direction of said endless belt, said second stretching roller (i) being rotatable about a second rotational axis, (ii) having a second play with respect to the second rotational axis, and (iii) having a second outer diameter larger than the first outer diameter, a contact portion between said second stretching roller and said endless belt with respect to the widthwise direction of said endless belt being a second contact portion having a second contact length, which is smaller than the first contact length, wherein, with respect to the widthwise direction of said endless belt, end portions of the first contact portion within the first play are outside end portions of the second contact portion within the second play.

* * * * *